United States Patent [19]

Marietta

[11] 4,332,531

[45] Jun. 1, 1982

[54] VARIABLE DISPLACEMENT PUMP WITH TORQUE LIMITING CONTROL

[75] Inventor: Walter E. Marietta, Mentor, Ohio

[73] Assignee: Parker-Hannifin Corporation, Cleveland, Ohio

[21] Appl. No.: 116,330

[22] Filed: Jan. 28, 1980

[51] Int. Cl.[3] ..... F04B 49/00

[52] U.S. Cl. ..... 417/218; 60/449

[58] Field of Search ..... 417/22, 212, 218, 222; 60/445, 447, 449, 452

[56] References Cited

U.S. PATENT DOCUMENTS

| | | | |
|---|---|---|---|
| 3,902,320 | 9/1975 | Marietta | 60/447 X |
| 3,935,707 | 2/1976 | Murphy et al. | 417/24 X |
| 3,941,513 | 3/1976 | Malott | 417/212 |
| 3,945,764 | 3/1976 | Marietta | 417/212 |
| 4,076,459 | 2/1978 | Adams et al. | 417/218 X |
| 4,162,874 | 7/1979 | Marietta | 417/216 |

*Primary Examiner*—William L. Freeh
*Assistant Examiner*—Edward Look
*Attorney, Agent, or Firm*—James A. Baker

[57] ABSTRACT

A variable displacement pump 1 includes a housing 2 having an inlet port 3 and an outlet port 4. The pump 1 is an axial piston pump having a swash plate 5 which is actuated to different angular positions by an actuating member 7. The torque limit of the pump 1 is controlled by a horsepower control valve 19 and a speed responsive control valve 35, which change the torque limit of the pump 1 in response to changes in the position of the actuating member 7 and in response to changes in the speed of the engine 33. In this manner, the torque limit of the pump 1 for any position of the actuating member 7 closely approximates the maximum available output torque of the engine 33.

14 Claims, 6 Drawing Figures

VARIABLE DISPLACEMENT PUMP WITH TORQUE LIMITING CONTROL

BACKGROUND OF THE INVENTION

Axial piston variable displacement pumps with hydraulic swash plate actuators are disclosed in Malott U.S. Pat. No. 3,941,513 and in Marietta U.S. Pat. Nos. 3,945,764 and 4,162,874. In all of these patents, a horsepower control valve for the pump changes the torque limits of the pump in response to changes in the position of the swash plate actuator.

SUMMARY OF THE INVENTION

The present invention provides a variable displacement pump in which the torque limit of the pump is changed both in response to changes in the position of the swash plate actuator and in response to changes in the speed of the engine that is driving the pump. In this manner, the torque limit of the pump for any particular position of the swash plate actuator can correspond to the maximum available torque output of the driving engine for all normal operating speeds of the driving engine. This provides an improvement over prior horsepower controls, in which the torque limit for any particular position of the swash plate actuator corresponded to the lowest torque of the driving engine available over the range of normal operating speeds of the driving engine.

BRIEF DESCRIPTION OF THE DRAWINGS

These and other aspects and advantages of the invention are further described below in connection with the accompanying drawings, wherein.

DETAILED DESCRIPTION OF THE DRAWINGS

A. Construction

Figure 1:
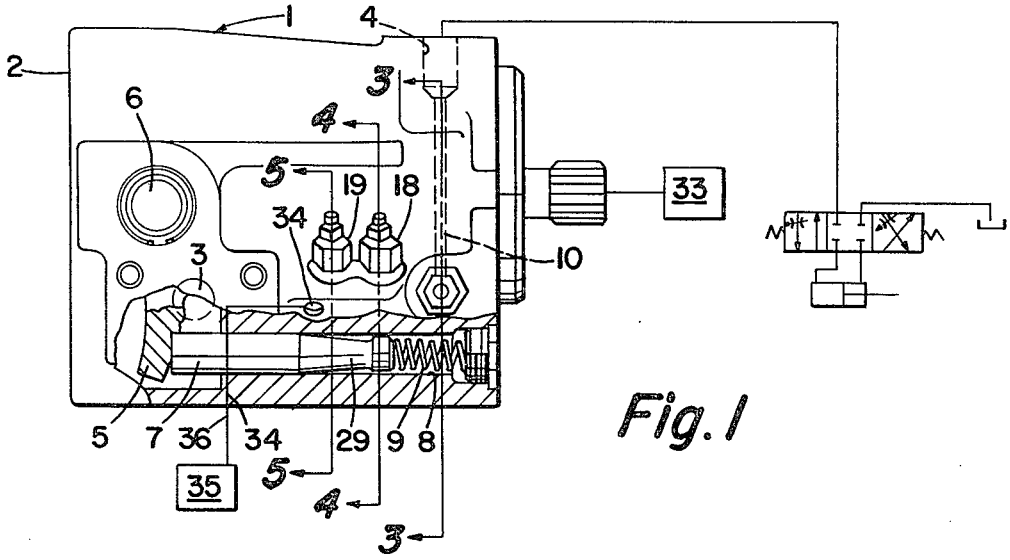
FIG. 1 is a side-elevational view partly in cross section of a variable displacement pump according to the present invention.

Referring now to the drawings in greater detail, FIG. 1 shows a variable displacement pump 1 having a housing 2, an inlet port 3 and an outlet port 4. The pump 1 is preferably an axial piston pump of the type shown in the patents discussed above, and the displacement of the pump 1 varies according to the angular position of a swash plate 5 which is pivoted at 6 to the housing 2. The swash plate 5 is actuated to different angular positions by a swash plate actuating member or piston 7 which is slidable in a bore 8 of the housing 2 and which is biased by a spring 9 toward the swash plate 5. The pump 1 is driven by a prime mover 33, which is an internal combustion engine in the preferred embodiment. The internal combustion engine 33 has a predetermined relationship between its maximum available output torque and its speed, and a speed responsive control valve 35 matches the torque limits of the pump 1 for any position of the actuating member 7 to the torque speed curve for the engine 33, in a manner described below.

Figure 2:
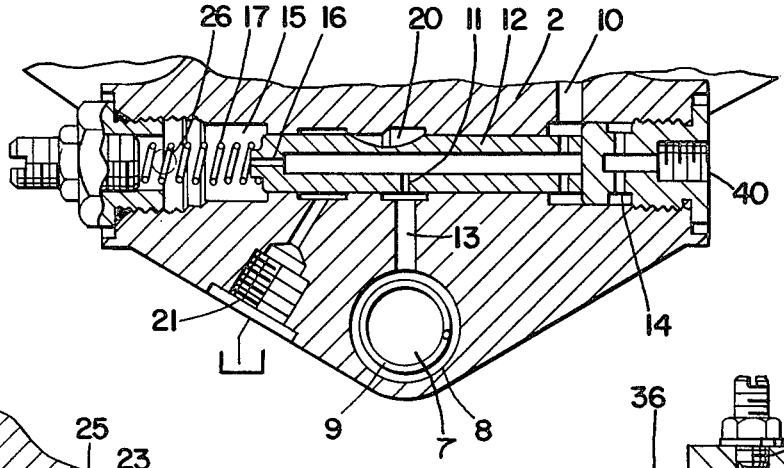
FIGS. 2, 3 and 4 are cross-sectional views taken substantially along lines 2—2, 3—3, and 4—4 of FIG. 1.

Referring now to FIG. 2, fluid under pressure from the high-pressure zone of the pump 1 is conducted into bore 8 by way of a housing passage 10, an orifice 11 in a modulator 12, and a housing passage 13. When the modulator 12 is in the position shown in FIG. 2, the pressures in chambers 14 and 15 at opposite ends of the modulator 12 are equalized by a modulator orifice 16, so that a spring 17 maintains the modulator 12 in that position. However, when the pressure in the chamber 15 is decreased by the opening of a constant pressure limiting valve 18 (FIG. 3) or by the opening of a horsepower control valve 19 (FIG. 4), the resulting pressure drop across the orifice 16 causes the higher pressure level in the chamber 14 to move the modulator 12 to the left as viewed in FIG. 2. This decreases the pressure in the swash plate actuator bore 8 by bleeding this pressure through a bleed orifice 20 to a drain port 21. The swash plate actuator 7 will then move to the right as viewed in FIG. 2 to decrease the displacement of the pump 1.

Figure 3:
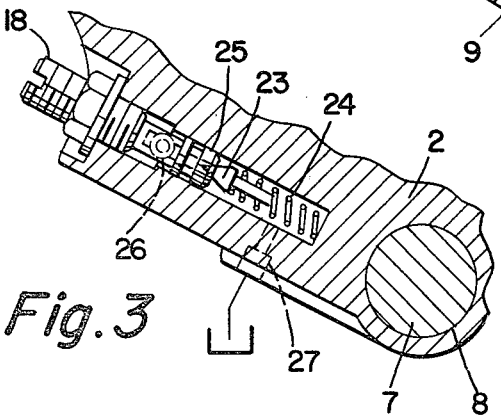

As shown in FIG. 3, the constant pressure limiting valve 18 includes a valve member 23 biased by a spring 24 into engagement with a seat at the end of an adjustable valve body 25. The upstream side of the valve member 23 is communicated with the pressure chamber 15 by way of a passage 26, and the downstream side of the valve member 23 is communicated by a passage to a drain port 37. By turning the valve body 25, the compression of the spring 24 will be increased or decreased to change the pressure level at which pressure in the chamber 15 will force the valve member 23 away from its seat.

Figure 4:
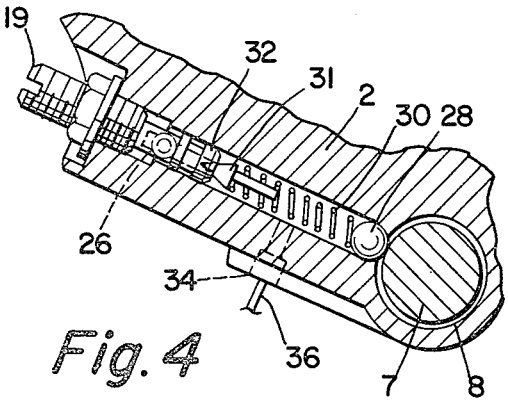

As shown in FIG. 4, the horsepower control valve 19 is of construction similar to that of the pressure limiting valve 18. However, a spring follower 28 in the form of a ball engages a cam surface 29 on the swash plate actuator 7 to increase the biasing force of the spring 30 on the valve member 31 as the swash plate actuator 7 moves in a displacement decreasing direction. The initial spring load is adjusted by rotating the valve body 32. The upstream side of the valve member 31 is communicated with the pressure chamber 15 via the passage 26, and the downstream side of the valve member 31 is communicated with the speed responsive control valve port 34.

Figure 5:
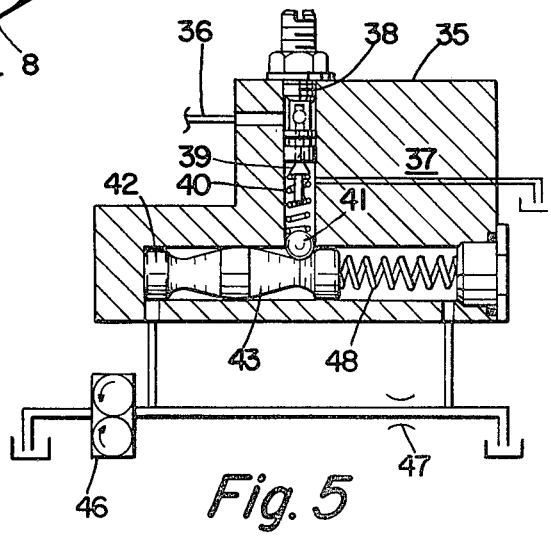
FIG. 5 is a cross-sectional side-elevational view of a speed responsive horsepower control valve shown schematically in FIG. 1.

The speed responsive control valve port 34 is communicated with the speed responsive control valve 35 by way of line 36. Referring to FIG. 5, the speed responsive control valve 35 includes a housing 37 having a valve body 38, a valve member 39, a spring 40 and a spring follower 41. As shown in the drawings, the valve member 39 is arranged in series downstream of the horsepower control valve 19 by way of the line 36. The speed responsive control valve 35 also includes a spool 42 slidably disposed in a bore in the housing 37. The spool 42 has a cam surface 43, and the cam surface 43 is contoured to alter the bias of the spring 40 on the valve member 39 in accordance with the speed of the engine 33, so that the relationship between the bias of the spring 40 and the speed of the engine 33 approximates the relationship between the maximum available output torque of the engine 33 and the speed of the engine 33.

The spool 42 is constructed and arranged so that its position in the bore is determined by the speed of the engine 33. This is accomplished by providing a gear pump 46 which is driven by the engine 33, so that the speed of the gear pump 46 is always directly proportional to the speed of the engine 33. The outlet of the gear pump 46 is connected directly to the left end of the spool 42 and is connected through an orifice 47 to the right end of the spool 42. By this arrangement, a pressure differential is provided across the spool 42 that is directly proportional to the speed of the engine 33. As this pressure differential increases, the spool 42 moves to the right against the bias of a spring 48. Although the preferred embodiment of the invention provides the gear pump 46 and orifice 47 to provide a signal that is indicative of the speed of the engine 33, other devices can alternatively be used to provide this signal. For example, a speed sensitive bleed off from the barrel of the pump 1 can be used to provide this signal hydraulically, or a tachometer can be used to provide an electrical signal that is used instead of the hydraulic signal.

B. Operation

Referring again to FIGS. 1, 2 and 3, the maximum pressure in the chamber 15 is limited by the pressure limiting valve 18. When the pressure in the chamber 15 increases to a value sufficient to unseat the valve member 23 against the force of the spring 24, the chamber 15 will be connected to drain. This will decrease the pressure in chamber 15 and cause the modulator 12 to move to the left. This will bleed the pressure in the swash plate piston chamber 8 to decrease the capacity of the pump 1.

Referring again to FIGS. 1, 2 and 4, the operation of the horsepower control valve 19 is similar to that of the constant pressure limiting valve 18. However, because the spring 30 is compressed between the valve member 31 and the spring follower 28, the bias of the spring 30 will change as the displacement of the pump 1 changes. The bias of the spring 30 is preferable less than the bias of the spring 24 under all conditions, so that the horsepower control valve 19 normally controls the pump 1 and the pressure limiting valve 18 provides only a maximum pressure control. The bias of the spring 30 is arranged so that the torque requirements of the pump 1 do not exceed the lowest available output torque of the engine 33, as determined by the torque speed curve of the engine 33 over its normal range of operating speeds.

Referring again to FIG. 5, the speed responsive control valve 35 is arranged to provide a back pressure in the line 36 and port 34 whose magnitude is a function of the speed of the engine 33. In this manner, the speed responsive control valve 35 increases the outlet pressure of the pump 1 at which the valves 18 and 19 will open. Thus, whereas the maximum pressure of the pump 1 for any position of the actuating member 7 would be a single fixed pressure level without the speed responsive control valve 35, the outlet pressure of the pump 1 for any position of the actuating member 7 will change in accordance with the speed of the engine 33 when the speed responsive control valve 35 is utilized. This permits the torque limits of the pump 1 to more closely match the maximum available output torque of the engine 33, so that greater horsepower output of the pump 1 can be obtained.

The contour of the cam surface 43 shown in FIG. 5 is arranged so that the bias of the spring 40 and hence the back pressure on the valves 18 and 19 is lower when the engine 33 is at very low or very high speeds. Also, the bias of the spring 40 and back pressure on the valves 18 and 19 will be larger at intermediate speeds of the engine 33. In this manner, the torque limits of the pump 1 for any particular position of the actuator 7 will be lower when the engine 33 has a lower available output torque such as at very high and very low speeds, and the torque limits of the pump 1 for any particular position of the actuator 7 will be higher at intermediate speeds of the engine 33 where the available output torque of the engine 33 is highest.

Figure 6:
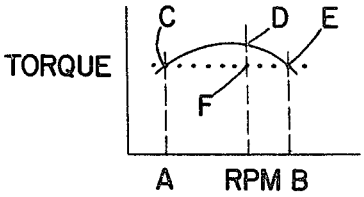
FIG. 6 is a graphical representation of the relationship between torque and speed for the pump and engine illustrated in FIG. 1.

The above-described operation of the preferred embodiment is illustrated by the graph shown in FIG. 6. In this graph, the speeds designated A and B correspond to the normal minimum and maximum operating speeds of the engine 33 and the pump 1. The solid line CDE shows the relationship between the maximum available output torque of the engine 33 and the speed of the engine 33. If the horsepower control valve 19 were connected directly to drain by the port 34 instead of being connected to the speed responsive control valve 35, the valve element 31 would be adjusted to open at a pressure level such that the torque limit of the pump 1 would correspond to the lowest available output torque of the engine 33 over its range of normal operating speeds. If this were the case, then the torque-speed relationship for the pump 1 would be as shown by the dotted line CFE in FIG. 6 for any particular position of the actuator 7. However, with the use of the speed responsive control valve 35 in conjunction with the horsepower control valve 19, a compensating means is provided which increases the torque limit of the pump 1 so that the torque-speed curve of the pump 1 closely approximates the solid line CDE for any position of the actuator 7.

What is claimed is:

1. A variable displacement pump comprising pump means, high and low fluid pressure zones operatively associated with said pump means, displacement adjusting means including a fluid pressure operated member changing the displacement of said pump means in response to increase in fluid pressure in said high pressure zone, a modulator valve having means controlling fluid communication between said member and at least one of said pressure zones, said modulator valve defining a pressure chamber, means establishing metered fluid communication between said high pressure zone and said pressure chamber, compensating means operative, upon increase of fluid pressure in said pressure chamber to a predetermined value, to intercommunicate said pressure chamber and said low pressure zone for movement of said modulator valve and for movement of said member in a displacement decreasing direction, and said compensating means including means changing said predetermined value in response to changes in the rotational velocity of said pump means.

2. A variable displacement pump as set forth in claim 1, including a prime mover operatively connected to rotate said pump means, said prime mover having a predetermined relationship between its maximum available torque output and its rotational velocity, and said changing means including means changing said predetermined valve in proportion to said predetermined relationship.

3. A variable displacement pump as set forth in claim 1, wherein said changing means includes a valve member, a spring acting against said valve member, and means changing the bias of said spring on said valve member in response to changes in the rotational velocity of said pump means.

4. A variable displacement pump comprising pump means, high and low fluid pressure zones operatively associated with said pump means, displacement adjusting means including a fluid pressure operated member changing the displacement of said pump means in response to increase in fluid pressure in said high pressure zone, a modulator valve having means controlling fluid communication between said member and at least one of said pressure zones, said modulator valve defining a pressure chamber, means establishing metered fluid communication between said high pressure zone and said pressure chamber, compensating means operative, upon increase of fluid pressure in said pressure chamber to a predetermined value, to intercommunicate said pressure chamber and said low pressure zone for movement of said modulator valve and for movement of said member in a displacement decreasing direction, said compensating means including means changing said predetermined value in response to changes in the rotational velocity of said pump means, and said compensating means including changing means including a valve member and means providing a back pressure on said valve member whose magnitude is a function of the rotational velocity of said pump means.

5. A variable displacement pump comprising pump means, high and low fluid pressure zones operatively associated with said pump means, displacement adjusting means including a fluid pressure operated member changing the displacement of said pump means in response to increase in fluid pressure in said high pressure zone, a modulator valve having means controlling fluid communication between said member and at least one of said pressure zones, said modulator valve defining a pressure chamber, means establishing metered fluid communication between said high pressure zone and said pressure chamber, compensating means operative, upon increase of fluid pressure in said pressure chamber to a predetermined value, to intercommunicate said pressure chamber and said low pressure zone for movement of said modulator valve and for movement of said member in a displacement decreasing direction, and said compensating means including first means changing said predetermined value in response to movement of said displacement adjusting means and second means changing said predetermined value in response to changes in the rotational velocity of said pump means.

6. A variable displacement pump as set forth in claim 5, wherein said first and second means each include a valve member, said first and second means are arranged in series relationship with one another, and said second means is downstream of said first means.

7. A variable displacement pump as set forth in claim 6 wherein said first and second means each include a spring acting against its valve member, said first means includes means changing the bias of its spring on its valve member in response to movement of said displacement adjusting means, and said second means includes means changing the bias of its spring on its valve member in response to changes in the rotational velocity of said pump means.

8. A control valve as set forth in claim 7, wherein said second means for changing the bias includes a movable cam surface.

9. A control valve as set forth in claim 8 wherein said movable cam surface is disposed on a movable spool, and said spool is movable in response to changes in the rotational velocity of said pump means.

10. A control valve as set forth in claim 8, wherein said movable cam surface is disposed on a movable spool, and said movable spool has a lateral area exposed to a fluid pressure signal whose magnitude is proportional to the rotational velocity of said pump means.

11. A fluid power system comprising a variable displacement pump, a prime mover operatively connected to drive said pump, and a fluid motor hydraulically connected to receive fluid from said pump; said prime mover having a predetermined relationship between its maximum available torque output and its rotational velocity; said variable displacement pump including pump means, high and low pressure zones operatively associated with said pump means, displacement adjusting means including a fluid pressure operated member changing the displacement of said pump means in response to increase in fluid pressure in said high pressure zone, a modulator valve having means controlling fluid communication between said member and at least one of said pressure zones, said modulator valve defining a pressure chamber, means establishing metered fluid communication between said high pressure zone and said pressure chamber, compensating means operative, upon increase of fluid pressure in said pressure chamber to a predetermined value, to interconnect said pressure chamber and said low pressure zone for movement of said modulator valve and for movement of said member in a displacement decreasing direction, said compensating means including means changing said value in proportion to said predetermined relationship in response to changes in the rotational velocity of said pump means, and said changing means including means responsive to a signal whose magnitude is indicative of said rotational velocity of said pump.

12. A fluid power system as set forth in claim 11 wherein said changing means includes a valve member, a spring acting against said valve member, and means changing the bias of said spring on said valve member in response to changes in said signal.

13. A fluid power system as set forth in claim 11, wherein said compensating means includes means changing said predetermined value in response to movement of said displacement adjusting means.

14. A fluid power system as set forth in claim 13, including means interconnecting said changing means in series relationship with one another, with said first mentioned changing means downstream of said second mentioned changing means.

* * * * *